United States Patent [19]

Huddle

[11] 4,092,992

[45] * June 6, 1978

[54] LAMINATED ARCH MEMBERS AND METHOD OF CONSTRUCTING THEM

[75] Inventor: Carl F. Huddle, Pleasant Ridge, Mich.

[73] Assignees: Tension Structures Co., Pleasant Ridge, Mich.; Jon D. Vredevoogd, Lansing, Mich.

[ * ] Notice: The portion of the term of this patent subsequent to May 21, 1991, has been disclaimed.

[21] Appl. No.: 660,450

[22] Filed: Feb. 23, 1976

[51] Int. Cl.[2] ..... A45F 1/16

[52] U.S. Cl. ..... 135/3 R; 29/155 R; 29/449; 52/63; 52/642; 52/731; 52/745; 135/DIG. 1; 135/15 CF

[58] Field of Search ..... 135/3 R, DIG. 1, 15 CF; 52/63, 642, 731, 732, 222; 29/155 R, 449; 428/110, 114, 174

[56] References Cited

U.S. PATENT DOCUMENTS

| | | | |
|---|---|---|---|
| 2,415,240 | 2/1947 | Fouhy | 29/449 X |
| 2,802,478 | 8/1957 | Fritsche | 135/15 CF X |
| 2,806,477 | 9/1957 | Fritsche | 135/15 CF X |
| 2,961,802 | 11/1960 | Morgan et al. | 135/15 CF X |
| 2,986,150 | 5/1961 | Torian | 135/15 CF X |
| 3,078,971 | 2/1963 | Wallerstein, Jr. | 52/642 X |
| 3,240,217 | 3/1966 | Bird et al. | 135/3 R |
| 3,415,260 | 12/1968 | Hall | 135/15 CF X |
| 3,469,587 | 9/1969 | Folkes | 135/15 CF X |
| 3,811,454 | 5/1974 | Huddle | 135/15 CF X |
| 3,909,994 | 10/1975 | Richter | 135/15 CF X |
| 3,953,955 | 5/1976 | Huddle | 135/4 R X |
| 3,995,081 | 11/1976 | Fant et al. | 52/731 X |

FOREIGN PATENT DOCUMENTS

| | | | |
|---|---|---|---|
| 1,464,812 | 11/1966 | France | 52/222 |
| 1,183,642 | 12/1964 | Germany | 135/1 R |

*Primary Examiner*—Werner H. Schroeder
*Assistant Examiner*—Conrad L. Berman

[57] ABSTRACT

Large hollow curved beams and arches are inexpensively produced by curving individual shallow components, such as channels, that are then tiered to form a large laminated member. Smaller beams or arches can be made by tiering the components, curving them all at one time, then fastening them together. Individual layers of curved components are usually fastened together consecutively or in multiple laminations to construct a member with a much higher moment of inertia than the sum of the moments of inertia of the layers in a non-fastened state.

30 Claims, 34 Drawing Figures

LAMINATED ARCH MEMBERS AND METHOD OF CONSTRUCTING THEM

BACKGROUND OF INVENTION

This invention was conceived while working on highly tensioned membrane structures such as described in my U.S. Pat. Nos. 3,215,153 entitled, "Architectural Structure;" Ser. No. 3,338,711 entitled, "Portable Structure;" Ser. No. 3,699,987 entitled, "Housing with Cable Suspended Panels;" Ser. No. 3,820,450 entitled, "Pavilion with Series of Arches;" Ser. No. 3,811,454 entitled, "Structural Membrane Attachment to an Arch," and other patents and applications of mine pertaining to such membrane structures in the United States and foreign countries.

This construction was described and illustrated in the Disclosure Document Program, Document No. 037221 entitled, "Beam or Curved Arch Construction and Method of Fabricating It;" Document No. 026665 entitled, "An Interlocking Laminated Beam, Adaptable for Curved Arches," and other prior documents and illustrations.

SUMMARY OF INVENTION

The primary object of this invention is to provide lightweight, curved, resilient arches to support tensioned membrane structures that are comprised of shallow or comparatively thin structural, prefabricated components that are easily curved to the arch shape desired, economically fastened together by welding, adhesives, mechanical feateners or locking to form strong, hollow, lightweight structural arches that have a continuous membrane attachment "built-in" the arch by which the membranes can be readily attached. In some constructions, the arch may be made without a fastening means incorporated in it or attached to it. In such construction a membrane can have an attachment fastened to the membrane such as a sleeve, boot or a pocket embodied inthe membrane.

Another object of this invention is to teach the method of constructing hollow beams, columns or arches that can be segmented and structurally spliced together by slip joints, adhesives, welding or mechanical fasteners.

Another object of this invention is to provide a construction of a long, hollow beam or an arch that can be fabricated at a construction site from shorter, straight, lightweight components that are more suitable for transportation. The beam or arch can be made in one piece or segmented with splice joints for easy dismantling and re-erection.

Another object of this invention is to locate the membrane attachments, in arch supported membrane shelters, in the completed arch fabrication where the attachments will add strength to the arch by adding to the bending resistance in the surface where the high bending stress is produced. In this way, double usage is made of the arch material in the fastener configuration.

Still another object of this invention is to provide one or more membrane attachment configuration, attached to or formed in the surface of the arch, that can be used in other ways such as the attachment of anchors, tie or safety cables, light fixtures, multiple membranes, etc.

Another object of this invention is to provide an arch, a straight or curved beam, that has an elastic rubber-type structural member bonded between layers of comparatively thin structural components (of which the beam or arch is constructed) to provide an added resiliency in the arch that is different from the resiliency of its other structural components, to better absorb work energy of deflection generated by uneven wind forces or sudden air pressure changes due to explosions.

BRIEF DESCRIPTION OF THE DRAWINGS

Arches for membrane shelters have many shapes from triangular and rectangular to highly curved arcs, semi-circles, catenary, hyperbolic and other curves and combinations thereof. If curved arches are formed by rolling, stretch bending or jacking, they are usually made of one or more arcs to simplify bending. Some arches described herein can be fabricted very economically on a fixed or adjustable form around wich their component parts can be shaped to the curve(s) desired. Others can be pre-shaped by various methods, progressively stacked and fastened together.

FIG . 20 shows two box sections bonded to an elastic, rubber-type, member between them.

Figure 21:
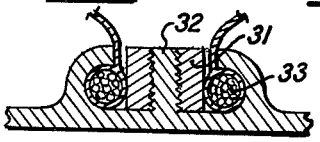

FIG. 21 illustrates a typical membrane attachment for these tensioned membrane structures.

Figure 22:
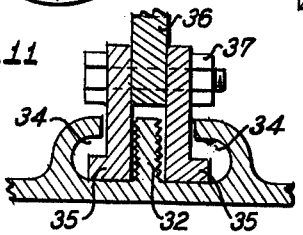

FIG. 22 illustrates how a tie cable, anchor safety cables, lights and other accessories can be attached to the attachment configuration fastened to or extruded in a beam or a structural arch member.

Figure 23:
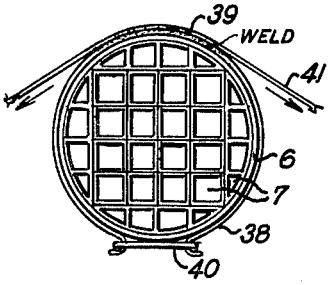

FIG. 23 illustrates a cross-section of an arch with a typica lacing method of attaching the membrane to the arch.

Figure 24:
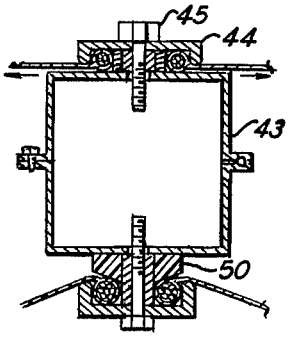

FIG. 24 is a cross-section of an membrane attachment to an arch by a channel locking strip and a channel retainer with locking strips.

Figure 25:
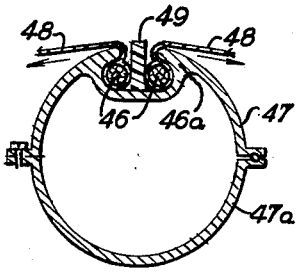

FIG. 25 is another cross-section of a membrane attachment to an arch using one locking strip between two membranes with rope edges.

Figure 26:
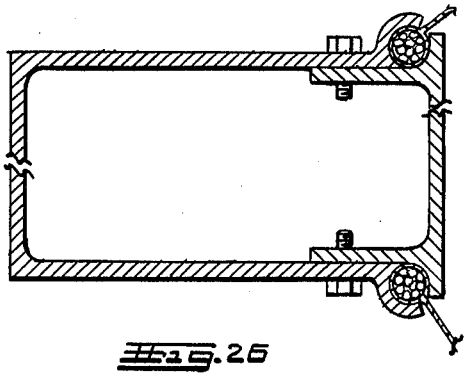

FIG. 26 illustrates the use of extrusions to contain a rope edged membrane without a separate locking strip.

Figure 27:
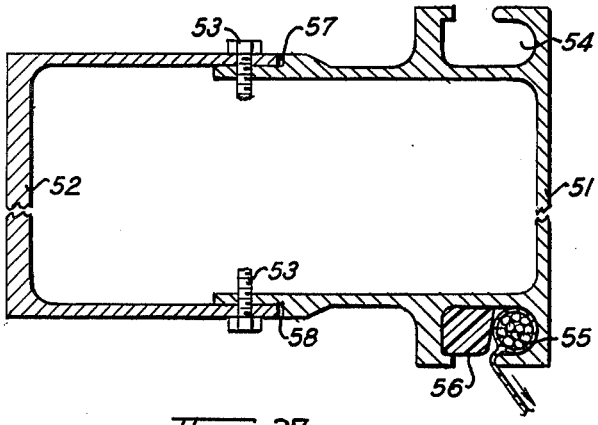

FIG. 27 is a cross-section of an arch having two channel type sections fastened together with mechanica fasteners.

Figure 28:
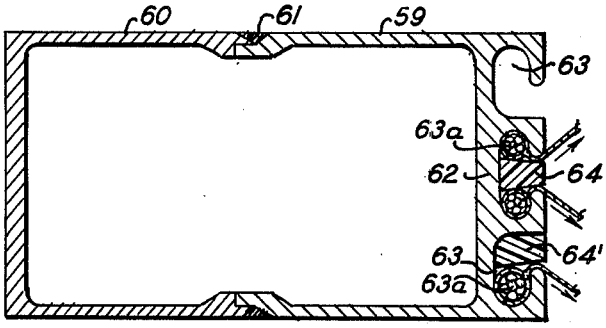

FIG. 28 is another cross-section of two channel type sections fastened together by welding.

Figure 29:
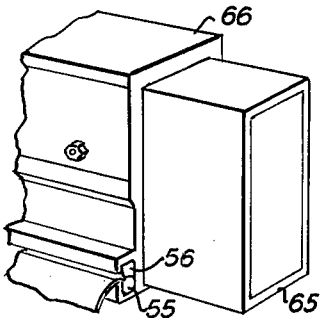

FIG. 29 illustrates a typical slip joint for an arch section such as FIG. 27.

Figure 30:
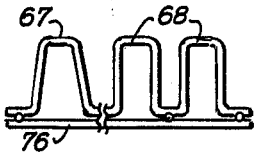

FIG. 30 shows a typical rolled or extruded basic section for a layered or laminated arch or beam construction.

Figure 31:
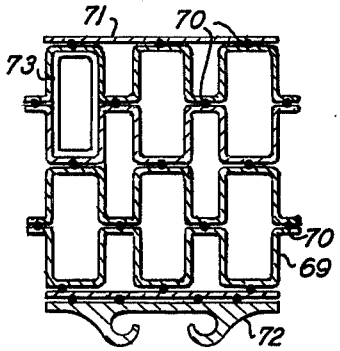

FIG. 31 is a cross-section of a typical arch or beam using the basic section shown in FIG. 30.

Figure 32:
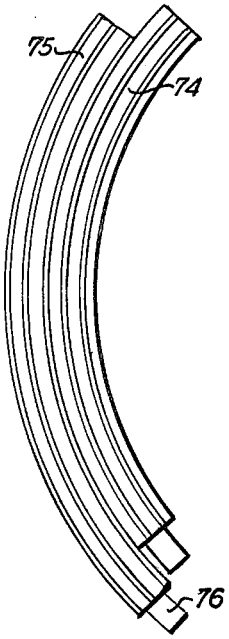

FIG. 32 illustrates a typical curved segment of a curved member constructed as shown in the cross-section FIG. 31 with protruding male section for a slip joint.

Figure 33:
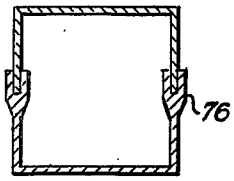

FIG. 33 illustrates the cross section view of box type arch member having an upper standard channel fastened to a modified lower channel.

Figure 34:
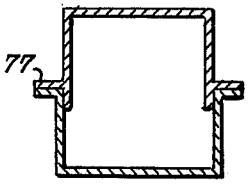

FIG. 34 illustrates the cross section view of a box type arch member including a lower typical hat section fastened to a modified upper hat section in an aligned manner.

DESCRIPTION OF THE PREFERRED EMBODIMENTS

FIGS. 1,2,3,4, & 5 illustrates various types of arch supported clear span structures. Note that the arches have many shapes but all can be resilient under load like an aircraft wing or a truck frame.

FIGS. 6 through 10 schematically shows many arch configurations (not shown are straightsections for triangular or rectangular arches) of circular shapes 1,2,3,4,5 of arcs, catenaries, hyperbolas, etc. All of these structures have been faced with the same problem of fabricating a lightweight low cost arch.

The handicap of high cost, rigid, heavy arches has delayed the extensive use of these structures throughout the world. While many arches have been made of steel, wood and aluminum, but in all cases, it has been the heavyweight or the high cost of shaping the arches to the desired curves that has delayed public acceptance of these efficient shelters. The structures that have been sold to date have been principally due to the glamorous contour or the reliability of the frame supported shelters. High transportation costs and high erection expense has also been a factor in reducing sales.

Lightweight, inexpensive arches can be designed to act under load like large, curved springs that deflect or sway under loads within the elastic limits of the materials used in the arch. This feature when combined with suitabe membrane inward curvature between arches that opposes excessive arch deflection provides the most economical arch supported shelters that are dynamic but safe structures.

The fabrication of these much needed, lightweight, lost cost arches should open up an almost unlimited market for this family of frame supported shelters.

FIGS. 11 through 16 cross-sections of a few typical arch structural members that can be economically constructed with this idea. Straight columns and beams as well as many arches of various curved shapes, composite curves with even very shallow deviations or straight sections can be easily constructed as one piece or segmented arches.

Figure 1:
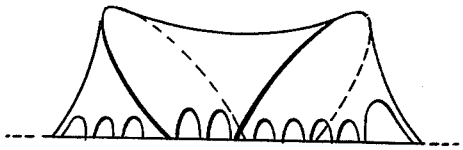
In FIGS. 1,2,3,4, & 5 are thumbnail sketches of some typical arch supported membrane shelters having curved inclined and vertical arches.
Figure 2:
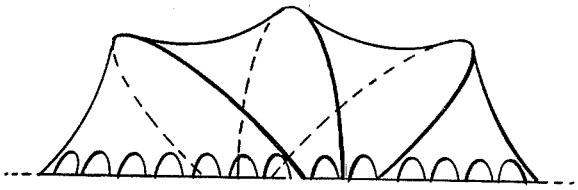
Figure 3:
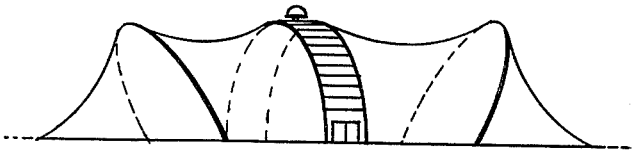
Figure 5:
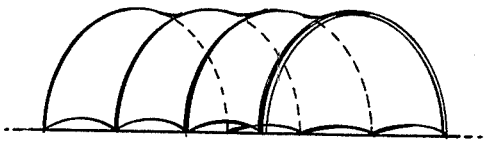
Figure 4:
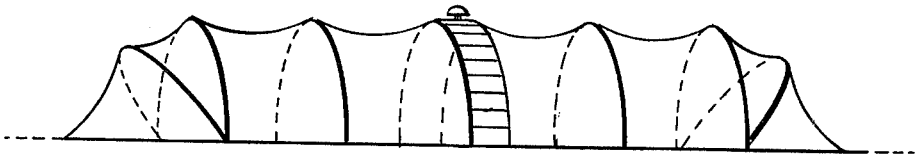
Figure 6:
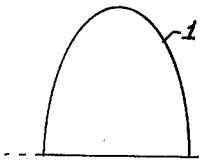
FIGS. 6,7,8,9, & 10 are typical shapes of the structural members used in typical arch supported shelters, schematically illustrated.
Figure 7:
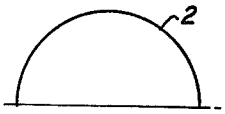
Figure 8:
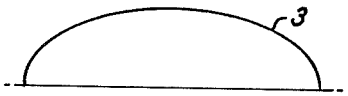
Figure 9:
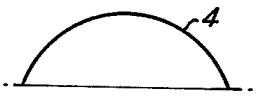
Figure 10:
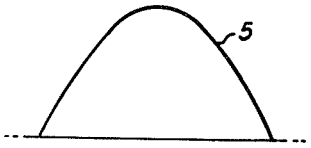
Figure 11:
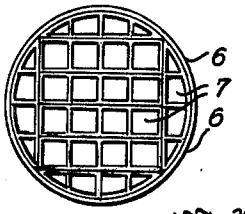
FIG. 11 shows a cross section of a lightweight hollow arch construction without any "built-in" configuration for membrane attachments. When arches are made of this basic construction, the membranes are attached by "lacing" or by the use of a pocket in the membrane that can be closed around the arch by lacing or other "point" fasteners.

A thin structural component, that is prefabricated, can be used as a laminate layer in constructing a structural member, such as the cell construction 6 & 7 of FIG. 11, a pultrusion composite of such materials as fibre glass and expoxy resin can be progressively bonded together by structural adhesives or other methods after it is shaped to the desired contour. If circular cross-sections are desired, for a laced attachment to membranes, a thin section 6 can be bonded to the inner core of thin sections 7 to form a circular shape from a rectangular or square cross-sectional shape.

Figure 12:
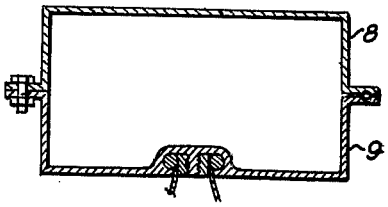
FIG. 12 is a cross-section of a typical hollow beam or an arch with a membrane attachment configuration formed in the inner arch surface.
Figure 13:
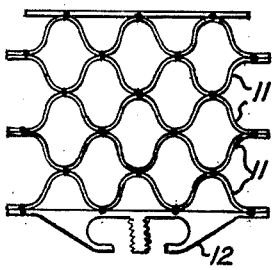
FIG. 13 is a cross-section of a corrugated arch with a membrane attachment.

Other extrusions such as the corrugated type 11, FIG. 13, or the channel type 8 & 9, FIG. 12 can be hand or machine welded together to make large, hollow, box type cross-sections or the hat section 8 or 9 can be mechancially fastened together by bolting, screws, crimping or spot welding. Fairly thin sections for large curves of 30–80 feet or more radii can be built up or constructed of standard components such as channels 16 and plates 15 and interposed between sections 17 and/or 14, FIG. 15. Hat sections 8 with flanges, can be turned inward or outward, the wall thickened at the point of joining two channel type layers by welding and decorative thin strips 14 can be added as desired.

Figure 16:
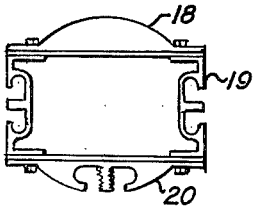
FIG. 16 shows how multiple membrane configuraton attachments can be "built-in" the laminated arch member for attachment of multiple membranes or to attach cables, anchors, accessories, etc.

Typical membrane fastener configurations extruded, rolled or formed otherwise, in shallow channels such as 9 or 20 are usually assembled in the exterior layers or laminates of the arch, on the inside or outside of the arch curvature, but can also be installed on the arch sides as well, like in FIG. 16.

In FIG. 12 the membrane attachment is on the inside channel member 9 of a typical box type arch cross-section, when it is desired to feature exterior arches of clean design in a shelter.

In FIG. 13 a typical membrane attachment 12 is shown on the inner (or outer) surface of a corrugated arch. Two corrugations 11 are fixed together near their neutral axis and additional corrugations added as desired.

Figure 14:
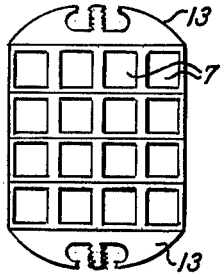
FIG. 14 illustrates a hollow cell arch construction that is suitable for bonding or laminating the cellular strips together by structural adhesives.

FIG. 14 illustrates the cell type laminates 7 that are bonded together for the inner core of a structural member with a fastener configuraton incorporated in another extrusion 13 bonded to the outer and inner surfaces of the arch structural member. The same construction, of course, can be used on straight structural members where the extrusion 18 can be placed on the sides for use as triangular or rectangular arches.

Figure 15:
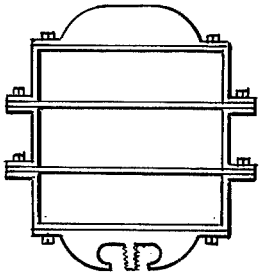
FIG. 15 illustrates how larger arch cross-sections can be constructed by progressively fastening together thin, hollow box strips made up of standard or special structural shapes.

FIG. 15 illustrates how a deep beam or an arch can be fabricated for greater stiffness by progressively laminating hollow box sections 16 that are attached to lamination 17 that has the attachment configuration in its surface.

FIG. 16 is another cross-section illustration of a progressively laminated structural member with attachment configurations on the inside 20 and the sides of the arch 19 with a rounded layer or laminated cap 18 on the exterior of the arch surface. Such designs and variations thereof can be used for multiple membrane attachments or attachments for tie cables, anchors, decorations, lights and the like, on the inside or outside of the shelter.

Figure 17:
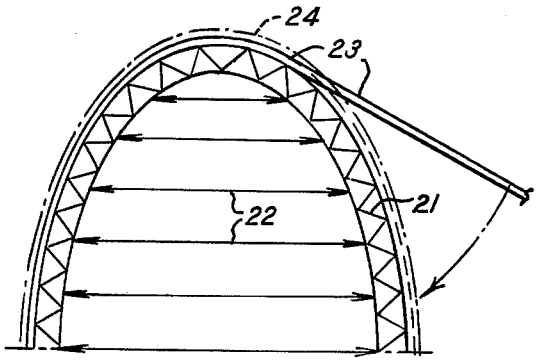
FIG. 17 is a schematic to show how an arch is curved on a typical form.

FIG. 17 illustrates schematically, a form 21, 22, made of such materials as wood, steel, concrete, by which thin prefabricated structural components can be individually and progressively shaped, stacked and fixed together to construct a curved layered or laminated structural member, in one piece or segmented. The innermost layer of a curved arch (or beam) 23 is first bent arund a form 21, which can be for the entire arch or a segment thereof, and clamped or otherwise fixed to the form; the next thin prefabricated structural component 24 is then bent around the form but over the first layer 23 and fixed there in position to be welded or otherwise fixed to the first component. The next layer or laminate, if any, is then bent around the form over the secnd laminate component and fixed to it, likewise any additional layers are added to form the complete structural arch member. This procedure in this application is called "progressive" lamination as opposed to bending all the thin laminate components at once and bonding them all together at the same time.

Figure 18:
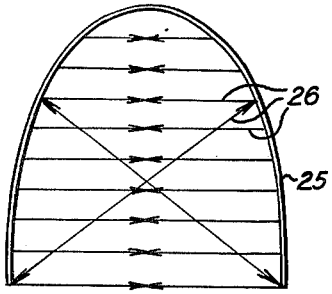
FIG. 18 shows how to form a curved arch by tie cables between the arch legs and/or with "X" tension members.

FIG. 18 shows an arch formed by bending the innermost thin laminate member 25 into the desired shape and holding it in this position by cross and "X" ties or tension members 26. The next laminate is then bent around and over the first one, the wo laminates clamped or fixed together for bonding, welding, or by the use of a mechanical fastening means similar to the progressive lamination of the component members by the use of a fixed form in FIG. 17.

In forming cruved arches or sections thereof in such methods as illustrated in FIGS. 17 or FIG. 18, it may be necessary to "over-bend" the arch curves due to "spring-back" of some arch materials such as heat treated aluminum alloys. With some arch materials the shapes may require rolling the sections to practically the arch curves desired, or to the desired curvature. In the latter case, such forms as illustrated in FIGS. 17 & 18 could be eliminated, as a form to shape the curves would be superfluous. In some shops that do not have rolling facilities, bending the sections of the laminated parts by stretch bending can be very accurate and economical if the amount of production is high enough to spread the initial cost of the forms needed. Other bending methods may be also suitable for some materials but usually individual bending on a "cut and try" method are too costly to provide economical arches.

Figure 19:
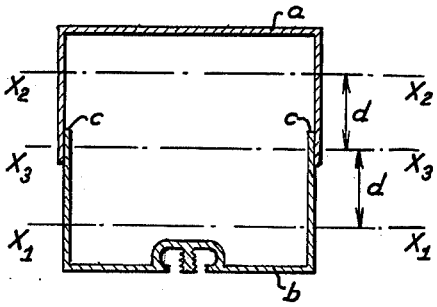
FIG. 19 is a schematic cross-section illustrating how the moment of inertia is increased by this construction of bonding, welding or otherwise fixing the slender structural components together.

In FIG. 19 a typical relationship of channel type laminations (a) and (b) are shown with the individual axes $X_1 - X_1$ and $X_2 - X_2$ which are then transferred by fixing the laminates together at (c) to the new axis $X_3 - X_3$. The increase in stiffness is indicated by the transfer of the individual moments of inertia by the quation: $\mathbf{1}_3 = \mathbf{1}_1 + Ad^2 + \mathbf{1}_2 + Ad^2$ where $\mathbf{1}_3$ is the new moment of inertia about the xis $X_3 - X_3$ and $\mathbf{1}_1$ and $\mathbf{1}_2$ are the moments of inertia of the individual laminates about their respective axes $X_1 - X_1$ and $X_2 - X_2$ and (d) is the distance between the $X_3 - X_3$ and $X_1 - X_1$ and between $X_3 - X_3$ and $X_2 - X_2$ and A is the area of cross-section of the respective laminates.

Examination of the equation indicates the great gain in relative strength that is accomplished by bonding the comparatively weak laminate members together to form a much stronger structural member, which in itself is not new art. However, this method of progressively laminating thin structural members together to form curved shapes or arches is feasible, inexpensive and an ideal way to produce hollow lightweight arches.

Figure 20:
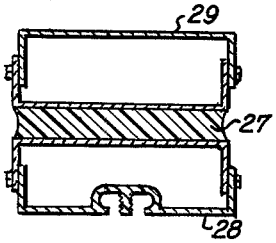

FIG. 20 illustrates a by-product of this construction where double channels or box sections 28, 29 are fastened to each other through a strong resilient, rubber-type material 27 to which they are securely bonded. While such method of bonding laminate members together will not provide a fixed neutral axis, or where it is placed beyond the neutral axis of the laminated structural member, it will provide resilience that can absorb work energy and shock loads better than the laminated structural member alone. Such conditions arise in great storms or from shock waves generated by explosions.

FIG. 21 illustrates a typical flexible membrane attachment where the rope edge 33 is held in the recess by the locking strip 31 which is prevented from working out of the attachment cave by the serrated stop 32.

FIG. 22 shows how a typical point attachment may be made in the continuous configuration formed in the exterior web or other section of the hollow structural member having recesses 34 and a serrated stop(s) 32 by inserting two angle shaped pieces 35 in the recesses 34 and locking them together with the attachment member 36 between them.

It is desired to emphasize that in a typical metal arch design as illustrated specially in FIGS. 12,15,16,20,24,27 and 28 that such configurations are suitable for rolling the individual pieces in approximate curved shapes of the tinal arches before the sections are fastened together. These hollow structural arches also are readily adaptable for sectionalizing by the use of slip joint sleeves inserted in their hollow interiors. In many cases these splice members can be made of standard mass produced components by designing the fabricated member to fit the splice components such as channels, bars, hollow tubes, angles, etc.

In cases where a joint occurs in a straight section such as a horizontal beam where the member is not under longitudina compression as in a column or an arch, it may be necessary to lock the members together by bolting, welding or other means.

FIG. 23 shows a cross-section of a typical round arch member with the membrane fastened to the arch comprised of sections 6 and 7 by a pocket 38 that is fastened to the membrane 41 by sewing or welding indicated at 39. The pocket can be opened and then laced 40 together to encompass the arch or the arch can be slipped through a closed pocket.

FIG. 24 is a cross-section of a membrane attachment to an arch 43 where the roped edge is held in a recess by a channel strip 44 which is attached to the arch by fasteners 45. Both membranes must be inserted under the channel retainer as the fastener is tightened. However, if it is desired to lock each membrane edge to the arch individually, the lower assembly that uses locking strips 50 with a channel retainer can be employed. These assemblies can be stacked to attach multiple membranes.

FIG. 25 is another cross-section illustrating still another method of locking the roped edges 46 to an arch 47 by the use of a formed pocket 46 extruded in the arch to receive the roped edges of the membrane 48 and retained in the pocket by the locking strip 49. Such an arch could be made from extrusions, stretch bending, or curving pull trusion arch members before the material sets.

FIG. 26 illustrates a membrane attachment that requires no locking strip such as 33, FIG. 21 but does require that the beaded edge be clamped or threaded in the recess. Such construction may be desired for small shelters.

FIG. 27 illustrates how extruded sections 51 and 52 can be assembled to form a hollow arch section by mechanically fastening them together by cap screws, bolts, screws or self-drilling and tapping screws 53. Membrane fasteners can be extruded in the arch, or rolled in, or fastened to the channel arch members that consist of an offset cavity 54 in which a beaded membrane edge 55 is retained by the locking strip 56. These hollow arches made of two channel type sections have flat upper and lower faces inside and outside which make them ideal for roling to their approximate curved shape prior to fastening them together. This may be preferable to bending them to shape against each other; as large channel sections are quite stiff and hard to bend. Note the notches 57 and 58 which make the sections easier to assemble and also adds bending resistance, requiring less fasteners 53.

FIG. 28 is another arch cross-section composed of two channel type members 59 and 60 that are welded together intermittently or continuously at 61. Sec. 59 has extruded in its outer face 62, offset continuous recesses 63, which serve as means to attach individually the beaded edges 63*a* of two or more membranes by use of strip locks 64.

Intermediate sections can be assembled between the channels shown in FIGS. 27 and 28 as illustrated in FIG. 15. Also, different methods can be used to fasten the sections together, such as folding and crimping by mechanical fasteners, welding, etc. the hat sections 8 and 9 shown in FIGS. 12 and 4.

Membrane fasteners can be made by "rolling" metal to fastener shapes, instead of extruding metal or composites, and then, attaching them to the arch sections, at any time, in the arch fabrication process; as illustrated in the lower face of FIGS. 13,14,15,16,20 and 31.

A modified corrugated basic shape is illustrated in FIG. 30. These inverted rectangular sections 68 can be extruded or modified as shown 67 to provide a better shape for rolling such shapes out of flat sheets. If the sides have appreciable slant, it may be necessary to tie the shapes together by a tension sheet 76 to prevent displacement of the shape under bending stress.

In FIG. 31 a built-up arch cross-section using the corrugated basic shapes in FIG. 30 is shown fastened together by spot welding 70 which is fast and economical. However, other fasteners can be used. Such an arch provides xcellent means for sleeve slip joints 73 which can be inserted in all the rectangular (or square) cavities, which can also be round, oval, etc. a flat plate 71 can be attached easily to the top or bottom or to both. The membrane attachment 72 an also be attached to the inside or outside face. A narrow membrane attachment means could also be attached on a side face if desired.

In FIG. 32 segments of typical arches are shown 74 and 75 that could be fabricated from a basic shape 67 or 68 or modifications thereof, or from channels such as shown in FIGS. 26,27,28 or others illustrated. Such basic shapes can be rolled or otherwise curved, then fastened together by any practical method. A typical sleeve joint can be used for arches under compression and/or where membrane tension maintains the male section 76 in the female section of such a slip joint. Such a condition exists in the shelters that are supported by curved arches described in my vertical and inclined arch structures.

While most of the arch member constructions illustrated and described can be made from various metals such as auminum or steel alloys, some materials may be unsuitable to form curves by bending (such as plastic-fibre composites) wood or composites of wood and plastic materials or just plastic materials used alone. Some plastic types may be shaped longitudinally before they take their "set" and also joined or fixed together before their "set."

Lightweight, hollow arches of extruded aluminum alloys or plastic laminates are excellent material for many environments. Hollow wood laminates may be ideal for architectural treatment in such areas as parks or other recreational areas.

There are four distinct methods of constructing curved, resilient arch members, each comprising thin multiple layers of structural components to form curved segments or arches with curved bights by:

1. Bending the first layer to a predetermined shape, then simultaneously bending, stacking and fastening each successive layer over and to the prior layer respectively.
2. Pre-bending the individual layer sections by rolling, stretch bending, etc. the layers before they are stacked and fastened together consecutively or simultaneously.
3. Stacking the structural section layers on each other for sliding movement, then bending the layers to a predetermined longitudinal and fastening them together.
4. Stacking straight layer sections, fastening them together, then bending them to the contour desired by moving at least onf of the opposite ends of the assembled straight structural member towads the other.

Certain woods and/or wood composites can be used to construct hollow, partially hollow or solid arches for some applications.

This construction of straight or curved structural members lends itself to an ideal method for adding structural strength at any location along the structural member. As an example, a tube like shaped section can be inserted in one or more of the hollow spaces, in much the same way that a sleeve section 73, FIG. 31, is inserted in the spaces created by fastening the basic sections together as in FIGS. 13,14,15,20,23,28,31. These reinforcing members can be placed in the spaces as the structural member is being assembled and fastened to one or more of the section to prevent movement or to add additional strength.

In fabricating a curved arch such reinforcing members can be added at the maximum bending areas thereby providing a safe but more economical arch construction. Other structural members may need stiffening for other reasons such as to provide a means of spreading an imposed load due to a point attachment of anchors, accessories, etc. or to add strength for base connections, lift connectors, means to attach struts, safely cables and for other purposes.

It is desired to state that structural members can be constructed by stacking layers of sections together by progressively stacking and fastening them together or fastening them together after the partial or complete layers are stacked or held together and then fastened, randomly or otherwise.

Illustrations shown are not necessarily the ideal shape for sections. For example, sections shown in FIG. 12 may be deeper to provide a more square structural member while sections shown in FIGS. 25–28 may be more shallow for easier bending or rolling. (If more strength is desired, such members would require more layers). Requirements depend on the use of the member, the materials used, and the facilities available for fabrication.

Arches, for example, can be constructed by this method of multiple layers of sections that require very few fasteners that secure the sections to each other. In such construction, a component design to keep the sections stacked together such as FIG. 33 and FIG. 34 may be desirable to make sure arch deflections will not unstack the arches. Fasteners can be installed at 76 and 77 respectively as needed. Some arches under some conditions of use could require the sections to the fastened together at the ends only or at the ends and the apex — or again any member of fasteners up to and including a continuous fastener such as a continuous weld.

Since arch flexibility can altered from a construction having no fasteners between sections, where the total moment of inertia is the sum of the individual moments in inertia of the sections, to the new moment of inertia where the sections are fixed together as shown in FIG. 19, there is some design choice available in selecting the number of fasteners, especially at locations of high or critical stress. However, such construction makes available a method to further reduce fabrication cost by reducing the fasteners between layers or sections where they are not required for structural integrity.

I claim:

1. A substantially, hollow structural encompass or beam member having at least one predetermined curved bight, comprising multiple layers of comparitively twice longitufinal structural components aligned in an assembled layer upon layer to encompas at least one continuous longitudinal tubular cavity having a cross sectional area of at least wice the cross sectional area of the wall material encompassing said tubular cavity, and means for fixing said layers together to attain a high stiffness to weight ratio in said structural member.

2. The structural member described in claim 1 wherein at least one of said longitudinal cavities is intermittent.

3. The structural member described in claim 1 wherein said structural member includes prefabricated structural components of at least two different materials.

4. The structural member described in claim 1 wherein said longitudinal layers include in cross-section, at least one channel shaped layer.

5. The structural member described in claim 1 wherein said longitudinal layers include at least one corrugated layer.

6. The structural member described in claim 1 wherein said longitudinal layers include at least one cellular layer.

7. The structural member described in claim 1 wherein said longitudinal layers include at least one shallow box type layer.

8. The structural member described in claim 1 wherein said longitudinal layers are curved, forming a curved structural member.

9. The structural member described in claim 1 wherein said assembled structural member is internally reinforced by at least one non-continuous structural reinforcing component.

10. The structural member described in claim 1 with the addition of a membrane attachment means being fixed to at least one structural component.

11. The structual member described in claim 1 with the addition of a membrane attachment means being incorporated in said structural member.

12. The structural member described in claim 1 wherein said means to fix said longitudinal layers together includes at least one fastening within the crown of an arch member.

13. The structural member described in claim 1 wherein said longitudinal layers include prefabricated structural components made from inorganic materials such as metals or inorganic plastics, by extruding, rolling or press forming.

14. The structural member described in claim 1 wherein said longitudinal layers include prefabricated structural components of organic materials such as plastics, that are reinforced, unreinforced, molded or extruded.

15. The structural member described in claim 1 wherein said longitudinal layers include at least one layer of elastic rubber type material.

16. The structural member described in claim 1 wherein said means to fix said layers of structural components together include at least one spot, stitch or continuous weld.

17. The structural member described in claim 1 wherein said means to fix said layers of structural components together include at least one mechanical lock or fastener.

18. The structural member described in claim 1 wherein said means to fix said layers of structural components together include bonding by a structural adhesive.

19. The structural member described in claim 1 wherein said longitudinal layers include in cross section at least one hat shaped layer.

20. The structural member described in claim 1 wherein said member is constructed in longitudinal segments that are operatively connected to each other.

21. The combination described in claim 20 wherein said member includes at least one straight segment.

22. The structural member described in claim 20 wherein said segments have slip joints.

23. The method of constructing a curved structural arch, or a segment thereof, comprising multiple layers of comparatiely thin structural components consecutively stacked on each other, and means to fasten said layers together; that includes the following steps:

(a) prefabricating straight structural sections,
(b) constructing the first layer of the arch member by bending it to a predetermined shape,
(c) bending and stacking each additional layer over the prior layer,
(d) fastening each additonal layer to said prior layer,
(e) joining segments, if any, to assemble the arch.

24. The method described in claim 23 except that step (b) is omitted, the straight components are stacked together then bent to a predetermined shape in step (c).

25. The method described in claim 23 except that in step (d) said layers are individually fastened to each prior layer when each layer is stacked on the prior layer.

26. The method described in claim 23 except that said layers of structural components are pre-bent to an approximate longitudinal contour in step b) and stacked together in step c).

27. The method of constructing a structural arch or beam member having at least one curved bight, comprising multiple layers of comparatively shallow interior space having a cross-sectional area of at least twice the cross-sectional area of the material in said tiered layers, that includes the following steps:

(a) Prefabricating said individual layers of longitudinal components in desired cross-sectional shapes and lengths, (b) Preforming said individual layers to their approximate longitudinal contour as required for their assembled position in said structural member, (c) Stacking said individual layers and fixing them together in their assembled position in said structural member or in a segment thereof.

28. The method described in claim 27 wherein the structural components are tiered after bending to the longitudinal shape required in step (b), then fixed together simultaneously, as a unit, by at least one fastener.

29. The method of constructing a structural member as described in claim 27 except that said individual layers are curved and stacked consecutively in step b) and consecutively fixed together in step c) as each layer is stacked on prior layers.

30. The method described in claim 29 wherein the structural components are "over curved" in step (b) to provide for "spring back" after final assembly.

* * * * *

UNITED STATES PATENT OFFICE

CERTIFICATE OF CORRECTION

Patent No. 4,092,992 Dated June 6, 1978

Inventor(s) Huddle, Carl F.

It is certified that error appears in the above-identified patent and that said Letters Patent are hereby corrected as shown below:

Column 3, line 67, should read --Fig. 11 through 16 show cross sections of a few typical--

Column 5, line 5, "arund" should read --around --

Column 8, line 23, should read --predetermined shape and fastening them--
line 27, change "onf" to --one--
line 28, change "towads" to --towards--

Column 9, line 13, should read --flexibility can be altered--
line 16, change the first word "in" to --of--

UNITED STATES PATENT OFFICE

CERTIFICATE OF CORRECTION

Patent No. 4,092,992 Dated June 6, 1978

Inventor(s) Huddle, Carl F.

It is certified that error appears in the above-identified patent and that said Letters Patent are hereby corrected as shown below:

Claim 1, line 1, "encompass" should read --arch--.
line 4, "twice longitufinal" should read --shallow, longitudinal--; same line, "in a" should read --and--
line 5, "encompas" should read --encompass--
line 7, "wice" should read --twice--.

Signed and Sealed this

Twenty-first Day of April 1981

[SEAL]

Attest:

RENE D. TEGTMEYER

Attesting Officer

Acting Commissioner of Patents and Trademarks